US005096083A

United States Patent [19]

Shaw et al.

[11] Patent Number: 5,096,083

[45] Date of Patent: Mar. 17, 1992

[54] POLYETHYLENE SHIPPING DRUM

[75] Inventors: Mark D. Shaw; J. Tad Heyman; Laurence M. Bierce, all of Jacksonville, Fla.

[73] Assignee: Essef Corporation, Chardon, Ohio

[21] Appl. No.: 520,615

[22] Filed: May 8, 1990

[51] Int. Cl.[5] ..... B65D 53/00

[52] U.S. Cl. ..... 220/304; 220/288; 220/380; 220/675; 220/94 A; 215/10; 215/217; 215/330; 215/352; 206/519

[58] Field of Search ..... 220/288, 304, 357, 358, 220/378, 380, 94 R, 94 A, 675; 206/519, 520; 215/10, 330, 341, 348, 352, 217, 218

[56] References Cited

U.S. PATENT DOCUMENTS

| | | | |
|---|---|---|---|
| 2,467,979 | 4/1949 | Krueger | 215/352 X |
| 3,470,927 | 10/1969 | Craig | 215/352 X |
| 4,014,452 | 3/1977 | Galer | 220/288 X |
| 4,244,481 | 1/1981 | Kornelis | 215/348 |
| 4,298,132 | 11/1981 | Galer | 220/288 |
| 4,708,258 | 4/1987 | Shaw et al. | 220/288 |
| 4,736,859 | 4/1988 | Mayes et al. | 215/330 |
| 4,886,184 | 12/1989 | Chamourian | 220/306 |
| 4,934,547 | 6/1990 | Mayes et al. | 215/306 |
| 4,936,448 | 6/1990 | Holloway | 206/364 |

FOREIGN PATENT DOCUMENTS

| | | | |
|---|---|---|---|
| 2714036 | 10/1978 | Fed. Rep. of Germany | 206/519 |

OTHER PUBLICATIONS

Enpac Corp. Product Information Sheet.

Drawing showing prior art sealing arrangement.

*Primary Examiner*—Stephen Marcus

*Assistant Examiner*—Stephen Cronin

*Attorney, Agent, or Firm*—Wigman & Cohen

[57] ABSTRACT

A polyethylene shipping drum especially suited for shipping hazardous materials is disclosed. The drum comprises a molded container and closure which are threadably connected to each other to form a seal therebetween. A thread lock is provided for the threaded connection between the container and closure. The container has a plurality of indentations in the side wall thereof to provide ledges for stacking the containers one inside the other in a stable, nested relationship. An annular rim is provided on the closure with an inclined annular surface for retaining the sealing gasket in a groove without adhesives.

19 Claims, 4 Drawing Sheets

POLYETHYLENE SHIPPING DRUM

FIELD OF THE INVENTION

The present invention relates to a shipping drum and more particularly to a polyethylene shipping drum for use in shipping materials, such as hazardous materials and the like.

DESCRIPTION OF THE PRIOR ART

Polyethylene drums for use in containing hazardous materials for shipment are known in the art. In the United States, such containers as are used for shipping certain classifications of hazardous must be approved by the U.S. Department of Transportation (DOT). Some DOT regulations, such as 49 C.F.R. §173.12, require that containers used as outside packaging for some hazardous materials must comply with specified vibration, compression and drop test specifications.

In addition to meeting governmental specifications, such containers and their closures should be conveniently nestable or stackable one inside the other and, when a plurality of containers are nested or stacked, the stacked column should be very stable and not susceptible to toppling. It is also desirable that the containers be readily and conveniently destacked. It is therefore undesirable if the containers are nested or stacked in the manner, for example, of drinking cups, wherein the inner and outer sidewalls of the stacked containers are in circumferential contact requiring, in some cases, substantial force to separate them.

When polyethylene drums are used in lieu of metal or fiber drums, it is desirable that the polyethylene drum comprise a closure threadably connected to the container so as to be easily closed and sealed without the need for clamping rings or other fittings as are commonly used with metal drums. Threaded connections for a polyethylene drum are known in the art and have proved to withstand the rigorous testing required by DOT regulations without leakage. Nevertheless, to provide an additional measure of reliability and safety, particularly in connection with the vibration specifications the drum must meet, it would be desirable to prevent the possibility that the closure would unthread from the container to such an extent that leakage might occur. It would also be advantageous to construct the drum so that when the closure is threadably secured and sealed to the container, means are provided for inhibiting the opening of or tampering with the drum by unauthorized persons, yet at the same time permitting access to the drum contents by authorized persons. Such anti-vibration and antitamper objectives are desirably achieved by a thread locking or latching mechanism integrally molded into the closure and container.

One known polyethylene drum is disclosed in U.S. Pat. No. 4,708,258, the disclosure is incorporated herein by reference, is assigned to the assignee of the present invention. The drum according to that patent is a polyethylene drum having the capacity of overpacking a container as large as a standard 55 gallon steel drum. That known polyethylene drum is characterized by a molded threaded connection between the double-walled closure and the drum container. The container is provided with an enlarged diameter below the threaded connection so as to form an exterior annular shoulder at an upper portion thereof. Thus, when the containers are stacked or nested, the annular shoulder of each upper container rests on the annular upper lip or rim of the open end of the container to provide stability to a nested column of a plurality of the containers. While the stacking structure of this prior art polyethylene drum has been found highly effective in that it results in excellent stability of a nested column of containers, the outside diameter of the container is somewhat greater than necessary because of the enlarged diameter portion which forms the annular stacking shoulder. It would be desirable therefore to provide a container nesting feature without an enlarged diameter portion, but with excellent stability characteristics.

SUMMARY OF THE INVENTION

In view of the foregoing, it should be apparent that there still exists a need in the art for a durable, lightweight, polyethylene drum useful for shipping hazardous materials and which is capable of satisfying all the rigorous testing requirements of relevant DOT regulations. In addition, there is a need in the art for polyethylene shipping drums, the containers and closures of which are conveniently nestable in a stable column or stack.

The present invention satisfies those needs and others as will become hereinafter apparent. The shipping drum of the invention can be manufactured by conventional blow-molding or rotational molding (rotomolding) techniques which are well-known to those skilled in the art and therefore which are not described in further detail herein. The rotational molding technique is preferred over the blow molding process as will be apparent to those skilled in the art from the following description.

Briefly described, the drum comprises a container having a bottom wall and a slightly outwardly tapered side wall which terminates at an open end having an annular lip and a male thread integrally molded below the annular lip on the exterior wall of the container. The container is closed by a rotationally molded closure comprising a circular plate or lid with a depending annular skirt, the internal circumferential portion of which is molded with a female thread that threadably mates with the external male thread on the container. Both the container and closure are single-walled with a relatively uniform wall thickness.

The circular plate of the lid is molded with a stiffening pattern of indentations and with an upstanding annular rim at the outermost edge thereof. The annular rim forms a deep annular groove on the interior of the closure into which the annular lip of the container seals extends and against a resilient sealing ring or gasket inserted in the groove. The annular groove has an inwardly tapered portion along its outermost annular wall so as to retain the annular gasket in place without the need to adhesively or otherwise affix the gasket in the groove. This arrangement advantageously retains the sealing gasket firmly in place until the closure is threaded onto the container and makes it more convenient to replace a damaged gasket than if the gasket were adhesively bonded in place or otherwise affixed in the annular groove.

The upper extremity or terminates of the external male thread on the container and the upper extremity or terminus of the internal female thread on the closure are each molded with interrupted portions which, when threaded into engagement, form a thread lock that is releasable by distortion of the closure skirt and container wall adjacent the thread lock. The interrupted thread portions advantageously provide a thread lock that prevents unthreading of the threaded connection between the closure and container resulting from vibration or other forces. In addition, the thread lock provides an anti-tamper feature that discourages unauthorized persons from opening the drum because such persons lack knowledge of either the existence of the thread lock or the manner in which the thread lock may be disengaged.

On the tapered wall of the container immediately beneath the external male threads there is provided at least one pair of oppositely disposed, generally rectangular-shaped embossments extending outwardly from the container wall. These embossments are useful for gripping and holding the container against rotation when the closure is being threaded onto or off of the container. The embossments may be manually gripped or engaged in a fixture used to thread or unthread the closure. Two embossments arranged 180° apart are preferred although four embossments 90° apart may also be used.

Beneath the rectangular embossments the container walls are provided preferably with four indentations which are equi-angularly spaced 90° apart. The indentations are each formed with a vertical wall coincident with a chord on the circumference of the container. The vertical walls of the identations 180° opposite one another are generally parallel to each other and the vertical walls of adjacent indentations are generally perpendicular to each other. Thus, as viewed from the open end of the container, the four indentations appear as chordal ledges located 90° apart on the inside wall of the container. Such chordal ledges of a first container each extend inwardly a radial distance sufficient that the four edges engage the bottom wall of and stably support a second container inserted or nested in the first container. Similarly, a third container may be inserted in and supported on the four ledges of the second container, and so on until a stacked container column of eight or more containers is formed.

The lowermost extremity or edge of the annular skirt depending from the container closure preferably has an inside diameter slightly greater than the outside diameter of the upstanding rim on the circular plate of the closure. That arrangement permits the closures to be stacked or partially nested by engaging the skirt of a second closure over the upstanding rim of the first closure, then the skirt of a third closure over the upstanding rim of the second closure, and so on until a plurality of closures are stacked one upon the other.

With the foregoing and other advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
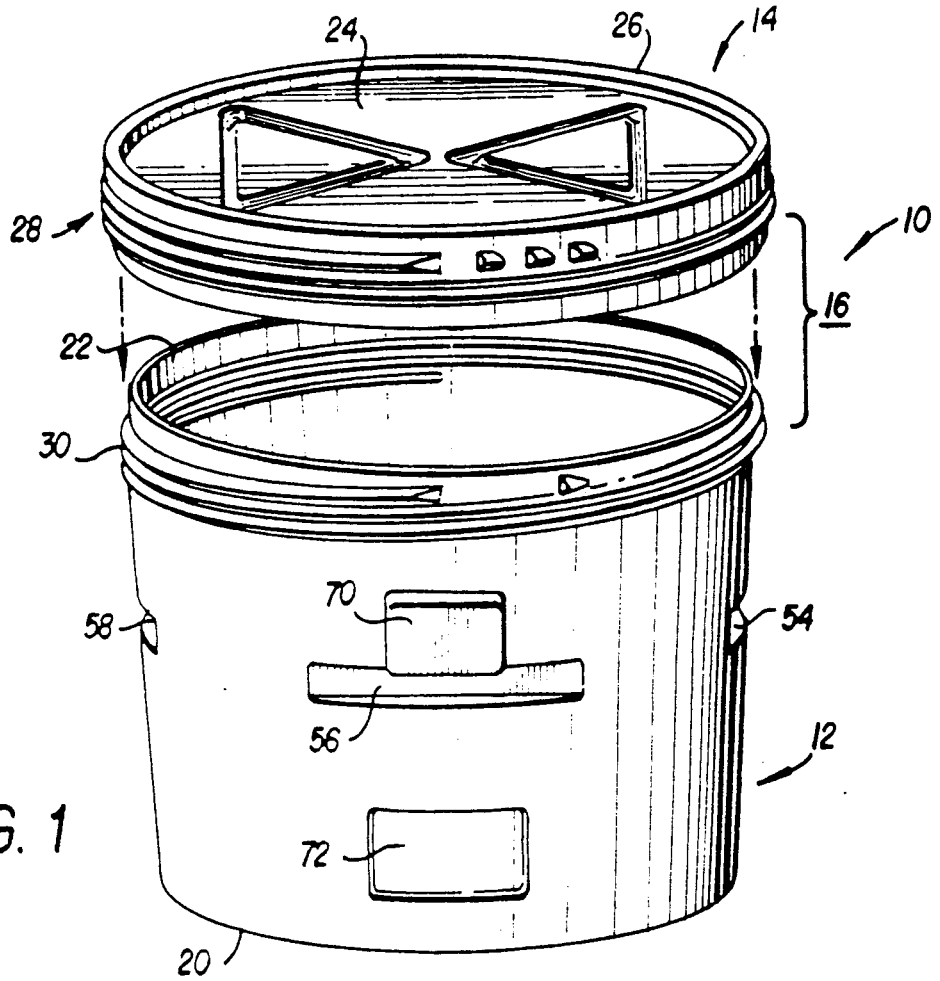
FIG. 1 is a perspective view of the polyethylene shipping drum according to the invention showing both the container and the closure or lid of the drum.

Referring now in detail to the drawings wherein like parts are designated with like reference numerals throughout, there is illustrated in FIG. 1 a polyethylene shipping drum according to the present invention which is designated generally by reference numeral 10.

Drum 10 comprises a container 12 and a closure 14 which are provided with a threaded connection 16 for securing the closure to the container in a sealing manner to be described hereinafter. The container 12 and closure 14 are formed by blow molding or rotational molding, preferably by rotational molding a polyethylene plastic material, such as a high density polyethylene or equivalent in a conventional manner. A suitable plastic material for rotational molding is a polyethylene resin available from the Mobil Oil Corporation under the designation NRP-135 and a suitable plastic material for blow molding is a polyethylene resin available from the Mobil Oil Corporation under the designation HYA-024. Although drums of various sizes and capacities may be molded, one suitable size that has been developed has an approximately 20 gallon capacity with an average diameter of about 19–20 inches, a height of about 17 inches and a nominal wall thickness of about 0.10 inches.

Figure 2:
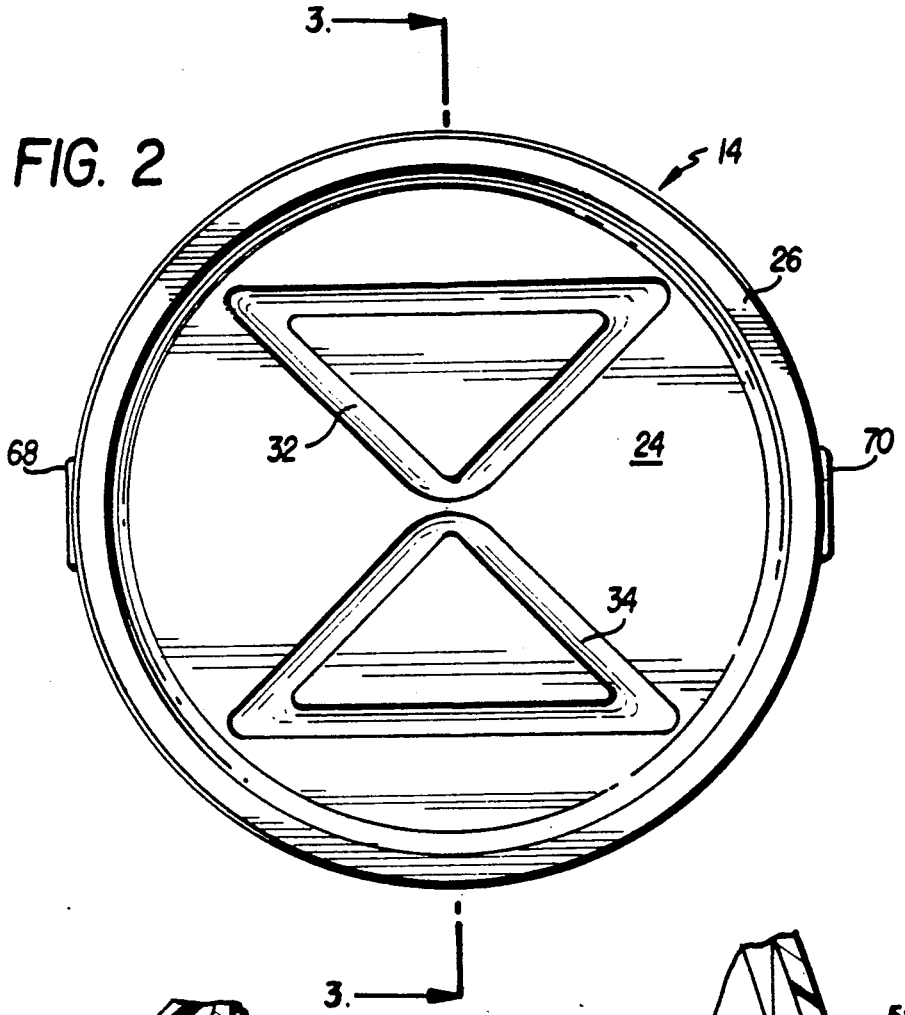
FIG. 2 is a top view of the polyethylene shipping drum of the invention showing the stiffening indentations in the closure.
Figure 7:
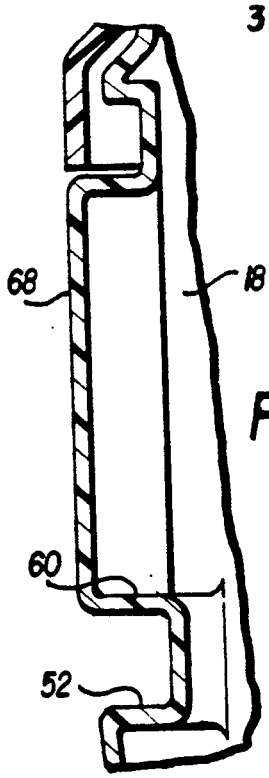
FIG. 7 is an enlarged fragmentary cross-sectional view taken along line 7—7 of FIG. 3.
Figure 6:
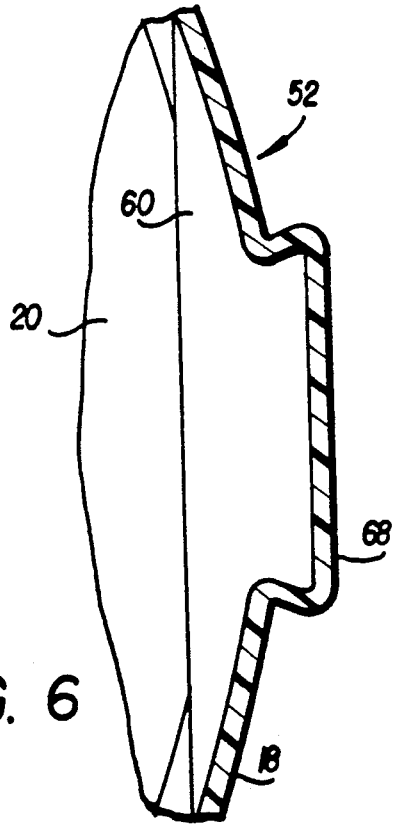
FIG. 6 is an enlarged fragmentary cross-sectional view taken along line 6—6 of FIG. 3.

The container 12 has a generally cylindrical wall 18 which is tapered slightly outwardly from the bottom 20 to the upper annular lip 22 thereof. Closure 14 comprises a circular plate portion 24 with an upstanding rim 26 and a depending annular skirt 28. The threaded connection 16 comprises a male thread 30 formed on the upper external wall of the container below the annular lip 22 and a female thread (not shown in FIG. 1) on the internal circumferential surface of the skirt 28. The male and female threads of threaded connection 16 each comprise 2 to 3, and preferably, 2.5 turns of right hand threads with a pitch of about 1.0 inch. FIG. 2 is a top view of the circular closure 14 illustrating the arrangement of stiffening grooves in the circular plate 24 of the closure. As shown, a pair of triangular recesses 32,34 are molded into the flat circular plate 24 with the apices of the trianguled recesses located adjacent each other at the center of the plate. This pattern of the recesses has been found to be a particularly advantageous in providing the required stiffness to the closure. The recesses 32,34 are relatively shallow and preferably in the range of 0.5 to 1.0 inches in depth.

Figure 4:
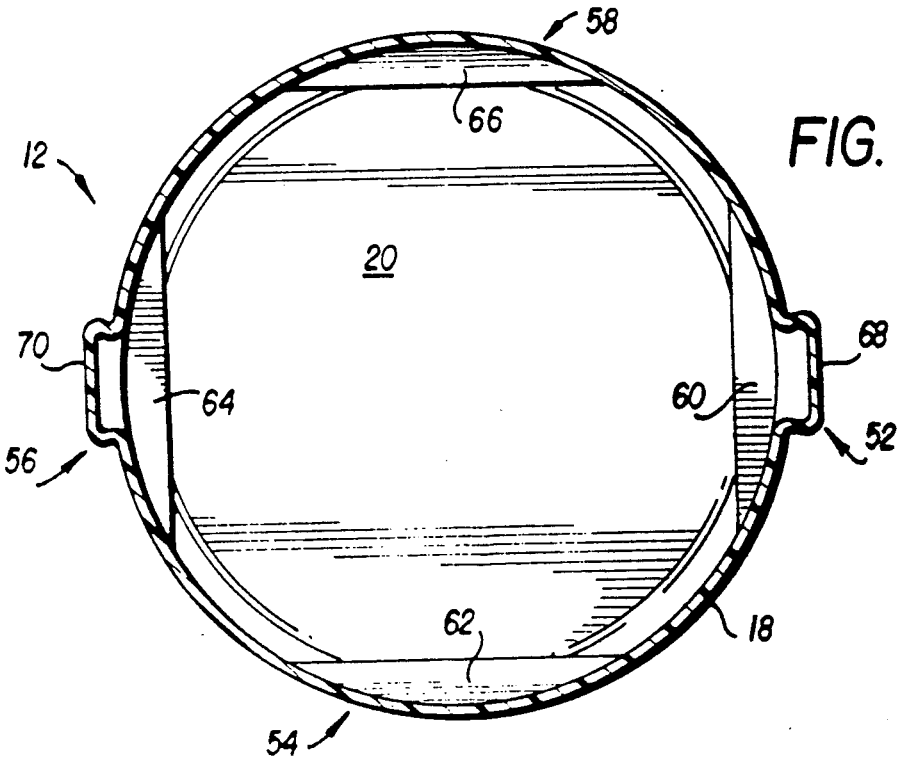
FIG. 4 is a cross-sectional view of the drum of the invention taken along line 4—4 of FIG. 3.
Figure 5:
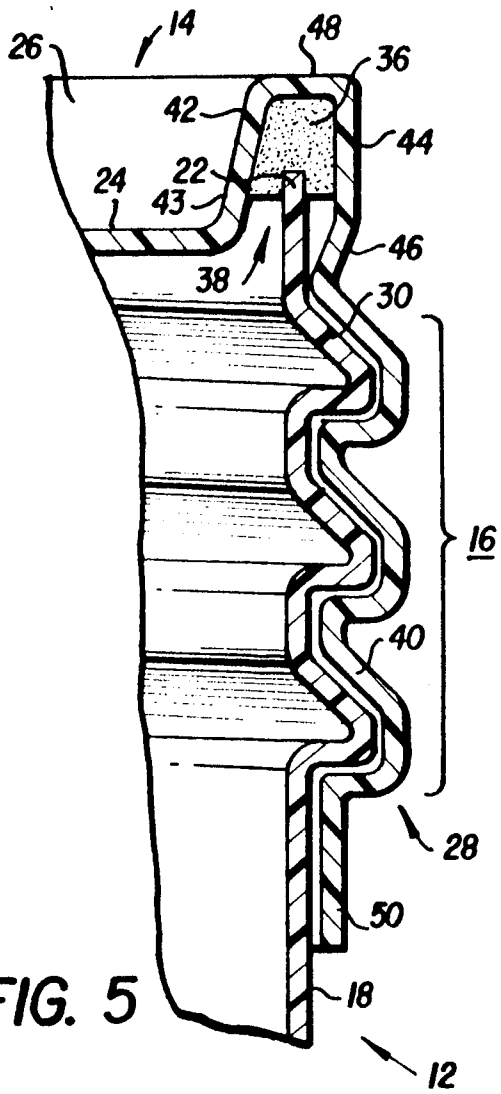
FIG. 5 is an enlarged view in cross-section of detail A of FIG. 3.
Figure 3:
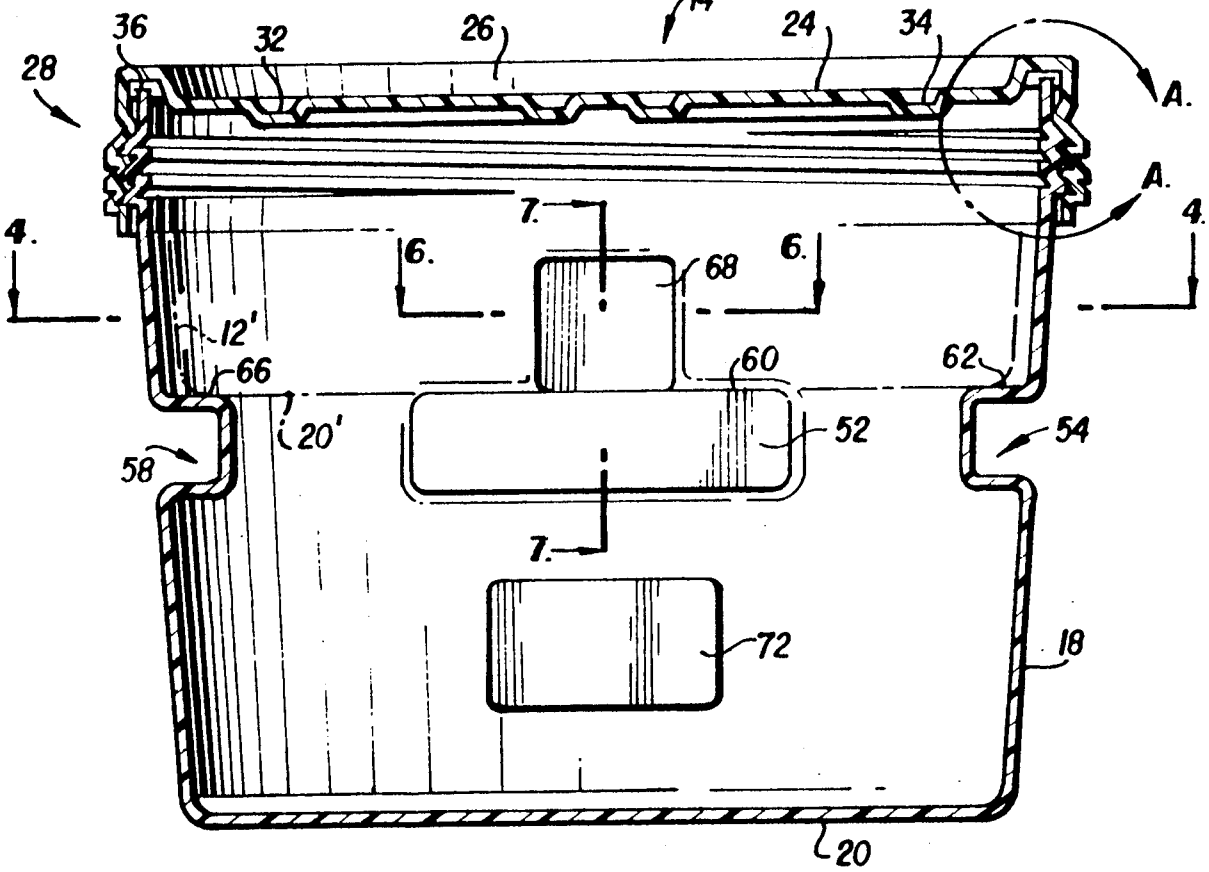
FIG. 3 is a side elevation view in a cross-section taken along line 3—3 of FIG. 2 showing the drum of the invention with the closure threaded onto the container.

Referring now to FIGS. 3–7, the construction of the various features of the invention are shown in more detail. As shown in FIG. 3, the bottom 20 of the container 12 is molded as a substantially flat circular plate which is upwardly curved at its periphery into the tapered wall 18 of the container. The closure 14 is shown threaded onto the container 12 with the annular lip 22 in sealing engagement with a resilient gasket ring 36 disposed in the groove 38 formed on the inside of the closure at the upstanding annular rim 26 as best seen in FIG. 5 which shows detail A of FIG. 3. The gasket 36 is preferably a polyethylene material but may be any other suitable gasket material. The threaded connection 16 (FIG. 5) comprises a male thread 30, preferably a right-hand thread, integrally molded on the upper external portion of the container wall 18 and a mating female thread 40, integrally molded on the inside surface of the annular skirt 28 of the closure 14. The thread diameter clearance will vary depending on the size of the drum. For the aforementioned 20 gallon capacity drum, a thread diameter clearance of about 1/16" has been found satisfactory.

An important feature of the invention is the arrangement of the sealing gasket 36 in the groove 38 of the closure. As best seen in FIG. 5, the annular groove 38 formed on the interior of the upstanding rim 26 has, as viewed in cross-section, a straight or vertical wall portion 42 which joins with an inwardly tapering wall portion 43 on the innermost diameter thereof and, on the outermost diameter thereof, a straight or vertical wall portion 44 which joins with an inwardly tapering wall portion 46. The wall portions 42,44 are joined at the top of the groove by a flat wall portion 48. The upper lip 22 extends into the groove 38 to a substantial depth so as to engage the gasket 36 and sealingly compress it against the flat bottom or wall portion 48 of the groove.

It will be appreciated that the upper annular lip 22 does not enter into the groove 38 until the last turn or half turn of the threaded connection. Accordingly, the gasket 36 must be retained in the groove 38 until the annular lip 22 engages it. Since it is desirable that the gasket not be adhesively bonded in the groove, retention of the gasket in the groove is accomplished primarily by the wall portion 46 which tapers inwardly from the diameter of the vertical wall portion 44 to a diameter smaller than the outside diameter of the gasket 36. Since the inside and outside diameters of the gasket 36 are approximately the same as the outside and inside diameters of vertical wall portions 42 and 44, respectively, the gasket 36 will be held in place. Moreover, when the closure 14 is inverted to the position shown in FIG. 1 preparatory to making the threaded connection 16, the gasket 36 will not fall out of the groove 38, but will be positively retained therein by the wall portion 46. As the thread connection is made, the upper annular lip 22 will engage the gasket 36 when the lip 22 enters the groove and will urge the gasket upwardly and compress it into sealing engagement with the wall 48 of the groove.

The lower depending wall portion 50 of the annular skirt 28 of the closure 14 extends downwardly a substantial distance from the lowermost terminus of the female thread 40 and has an inside diameter slightly greater than the outside diameter of the vertical wall portion 44 of the upstanding rim 26. The combination of the elongated skirt and the aforedescribed diametrical relationship advantageously permits a plurality of closures to be nested one above the other in a stable stack. The elongated skirt portion 50 of one closure is engaged over the upstanding rim 26 of another closure and so on until a stable stack is formed. Stacking the closures in this manner advantageously helps to prevent undesired warping or distortion of the closures.

Referring to FIGS. 3–4 and 6–7, it will be seen that the container 18 is provided with four indentations 52,54,56,58 of the same configuration arranged 90° apart about the mid-portion of the container wall 18. As best shown in FIG. 4, the indentations 52–58 form on the inside of the container wall 18 four chordal ledges 60,62,65,66 extending inwardly a distance sufficient to support another container 12' at four places on the bottom 20' thereof as shown in dashed lines in FIG. 3. This arrangement advantageously provides a stable stack of nested containers that is not readily toppled and from which stack the containers can be readily and easily removed one at a time.

The indentations 52–58 further provide means for lifting a drum after it has been filled with material and closed. For example, a pair of elongated handles having a rectangular cross-section may be inserted in an opposite pair of indentations 52,56 or 54,58 for manual lifting or a machine lift, such as a fork lift or the like, may be provided with a pair of similar lifting bars or handles.

Located immediately above the opposite indentations 52,56 are a pair of embossments 68,70, respectively, which are generally rectangular in shape. Embossments 68,70 function as handles for holding the container 12 in a fixed non-rotating position when the closure is threaded onto the container. The embossment handles 68,70 may be held manually or may be engaged by a fixture to prevent rotation of the container.

The container 12 may also be provided with shallow recesses or indentations on the exterior wall thereof, such as rectangular recess 72, for affixing labeling to the container. Recessing the labels advantageously helps to protect the labels from abrasion and tearing. Although not shown in the drawings, the container 12 including the bottom 20 and tapered sidewall 18 may be provided with additional stiffening indentations or recesses as desired and as determined by those skilled in the art.

Figure 8:
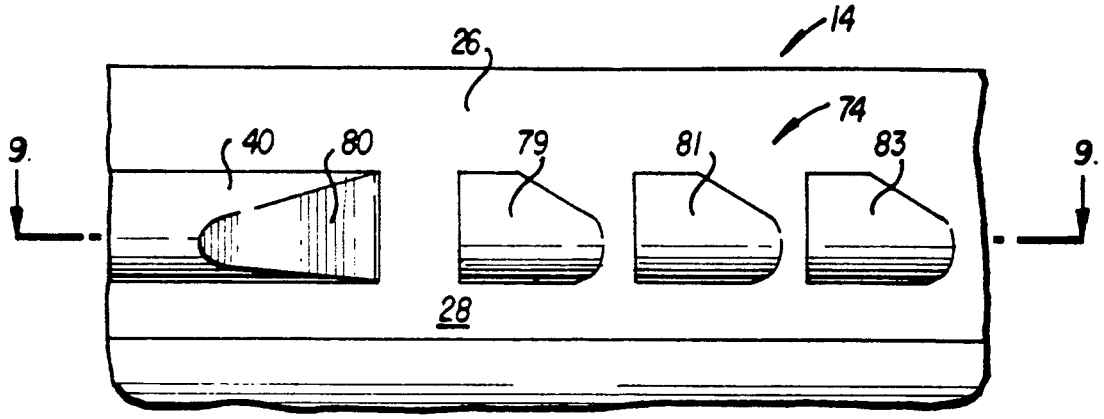
FIG. 8 is a side elevation view of an enlarged fragmentary detail showing the thread lock between the closure and container of the drum of the invention.
Figure 10:
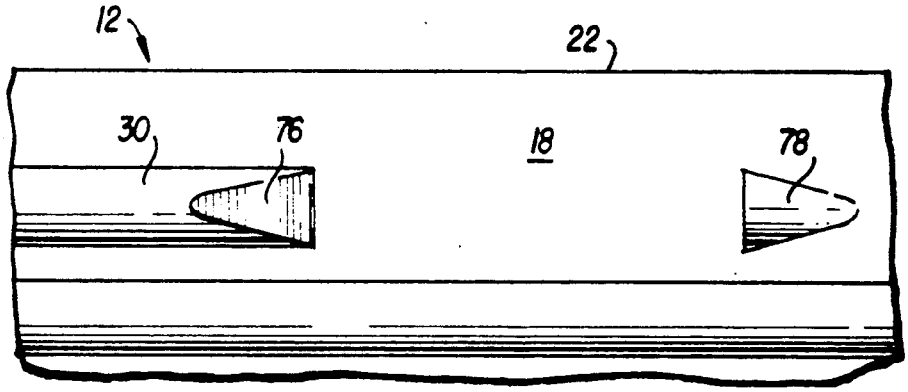
FIG. 10 is a side elevation view of an enlarged fragmentary detail showing the thread lock on the external male thread of the container which engages with the internal female thread on the closure.
Figure 9:
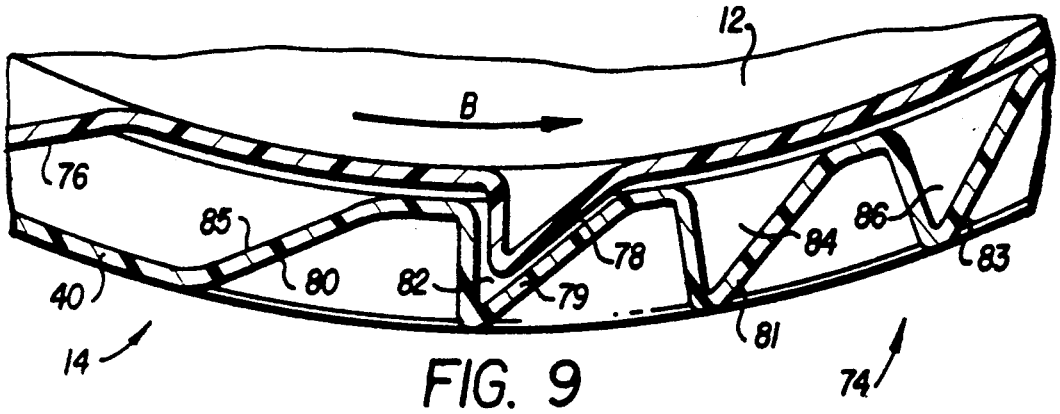
FIG. 9 is an enlarged fragmentary cross-sectional view taken along line 9—9 of FIG. 8 showing the thread lock engagement between the closure and container of the drum of the invention.

Referring now to FIGS. 8–10, there is shown a means for locking the threaded connection 16 between the container 12 and the closure 14. The threaded lock 74 is formed by an interlocking arrangement between the male thread 30 on the container 12 and the female thread 40 on the closure 14. At the upper extremity or terminal end portion of the threaded connection, the male thread 30 is interrupted by an inclined portion 76 of the thread which merges into the container wall 18 leaving a thread-shaped lug 78 at the end of the thread 30 and extending radially outwardly from the wall 18. The female thread 40 on the closure 14 is similarly interrupted by an inclined portion 80 which merges into the closure skirt 28. The terminal end of female thread 40 is provided with a plurality of thread-shaped lugs 79, 81, 83, the interiors of which form three female cavities 82, 84, 86 corresponding to first, second and third locking positions.

As the closure 14 is rotated toward the limit of threaded engagement with the container, the lug 78 on the container engages the interior side 85 of the inclined portion 80 and reacts with it to urge the closure 14 and container 12 away from each other at the location of the thread lug 78. As the closure continues to be rotated, the lug 78 moves counterclockwise relative to the first lug 79 as shown by the arrow B in FIG. 9 until the lug 78 snaps into the first female cavity 82. This first locking position is shown in FIG. 9 wherein the threads 30,40 are locked against unthreading.

Because of a number of variables, such as the magnitude of applied tightening torque, tolerance build up, molding variations, thermal expansion, weight of contained material and the like, a plurality of lugs 79, 81, 83 are provided so that different thread locking positions are possible. While three lugs 79, 81, 83 are shown, it will be appreciated that a greater or lesser number of lugs may be provided at varying angular positions. In one drum construction according to the invention, it has been found that a range of about 20° between the first and last legs or locking positions is adequate to accommodate the expected variables mentioned above. If the desired seal or the torque magnitude does not result when the drum lug 78 is located in the first thread locking cavity 82, the closure 14 is rotated further clockwise to again urge the container 12 and closure away from each other so that the lug 78 moves counterclockwise relative to the closure 14 as shown by arrow B in FIG. 9 and into the second thread locking cavity 84. Likewise, if the second thread locking position does not provide the required torque or seal, the closure 14 is rotated further clockwise to move the lug 78 into the third or last thread locking cavity 86.

If it is desired to disengage the thread lock 74, it is possible to apply an inward radial pressure on the wall 18 of the container below the thread lock, e.g., at embossment handle 70, and an outward radial force on the skirt 28 of the closure at the same location to disengage the lug 78 from the cavity 82, 84, or 86 and then rotate the closure 14 counterclockwise so that the lug rides along the internal surface 85 of the inclined wall portion 80 until it is again located in the female thread 40.

Although certain presently preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

We claim:

1. A molded plastic drum comprising:

a container having a side wall and a bottom wall, said side wall having an exterior surface, an interior surface and an annular lip, said exterior surface having a male thread formed therein adjacent said lip;

a closure having a top plate and an annular skirt depending from said top plate, said annular skirt having interior and exterior surfaces, the interior surface of the skirt having a female thread formed therein for mating with the male thread of the container; and thread locking means formed on said threads for releasably locking said threads against unthreading, said thread locking means comprising a first thread lug located at the extremity of the male thread of the container and a plurality of second thread lugs located at the extremity of the female thread of the closure, each of said second thread lugs having a cavity into which said first thread lug is interlockingly and releasably engagable, at least one of said container and closure being sufficiently resilient to permit disengagement of the first thread lug from the second thread lugs without damage to said container or closure.

2. The drum of claim 1, wherein said plastic is polyethylene.

3. The drum of claim 1, wherein said closure further comprises an annular rim having an internal annular groove formed therein, a sealing gasket retained in said groove, said annular lip sealingly engaging and compressing and gasket when said closure is threaded onto said container.

4. The drum of claim 3, wherein said gasket has an outer diameter, the groove in said annular rim comprising means for retaining said gasket in said groove, said retaining means including a wall portion having an inner diameter less than the outer diameter of the gasket.

5. The drum of claim 4, wherein said wall portion is inwardly inclined.

6. The drum of claim 1, wherein said container includes a plurality of indentations formed in the side wall thereof, said indentations forming ledges on the interior surface of the side wall for supporting another like container in a nested relationship.

7. The drum of claim 6, wherein said plurality of indentations comprise four of said indentations arranged at substantially 90° to one another and forming four of said ledges.

8. The drum of claim 6, including at least two embossments formed in the side wall of the container opposite one another, said embossments comprising handles for holding said container against rotation during the threading of the closure onto the container.

9. The drum of claim 8, wherein said embossments are generally rectangular in shape and are aligned with said indentations.

10. A molded plastic drum comprising:

a container having a side wall and a bottom wall, said side wall having an exterior surface, an interior surface and an annular lip, said exterior surface having a male thread formed therein adjacent said lip;

a closure having a top plate and an annular skirt depending from said top plate, said annular skirt having interior and exterior surfaces, the interior surface of the skirt having a female thread formed therein for mating with the male thread of the container, said closure having an annular upstanding rim forming an annular internal groove, a sealing gasket having an outer diameter positioned in said groove, said groove comprising means for retaining said gasket in said groove, said retaining means including an inwardly inclined wall portion having an inner diameter less than the outer diameter of the gasket, said annular lip sealingly engaging and compressing said gasket when said closure is threaded onto said container; and thread locking means formed on said threads for releasably locking said threads against unthreading, at least one of said container and closure being sufficiently resilient to permit disengagement of said thread locking means without damage to said container and closure.

11. The drum of claim 10, wherein said container includes a plurality of indentations formed in the side wall thereof, said indentations forming ledges on the interior surface of the side wall for supporting another like container in a nested relationship.

12. The drum of claim 11, wherein said plurality of indentations comprise four of said indentations arranged at substantially 90° to one another and forming four of said ledges.

13. The drum of claim 10, including at least two embossments formed in the side wall of the container opposite one another, said embossments comprising handles for holding said container against rotation during the threading of the closure onto the container.

14. The drum of claim 13, wherein said embossments are generally rectangular in shape and are aligned with said indentations.

15. The drum of claim 10, wherein said thread locking means comprises a first thread lug on the male thread of the container and a second thread lug on the female thread of the closure, said second thread lug having a cavity into which said first thread lug is interlockingly and releasably engagable.

16. The drum of claim 15, including a plurality of second thread lugs on the female thread of the closure, each second thread lug being angularly spaced relative to one another about the closure circumference.

17. The drum of claim 10, wherein the annular skirt of the closure has a free annular edge with an inner diameter, the outer diameter of the rim of the closure being less than the inner diameter of the free annular edge whereby the free annular edge of one closure is nestable over the annular rim of another like closure.

18. A molded plastic drum comprising:

a container having a sidewall and a bottom wall, said side wall having an exterior surface, an interior surface and an annular lip;

a closure having a top plate and an annular skirt depending from said top plate, said annular skirt having interior and exterior surfaces;

at least three indentations formed in the side wall of said container, said indentations forming ledges on the interior surface of the side wall for supporting another like container in a nested relationship;

a male thread formed on the exterior surface of the container adjacent said lip and a female thread formed on the interior surface of said annular skirt for mating with the male threads of the container;

thread locking means formed on said threads for releasably locking said threads against unthreading, said thread locking means comprising a first thread lug on the male thread of the container and a plurality of second thread lugs on the female thread of the closure, said second thread lugs each having a cavity into which said first thread lug is interlockingly and releasably engagable, each second thread lug being angularly spaced relative to one another about the closure circumference; and at least two embossments formed in the side wall of the container opposite one another, said embossments comprising handles for holding said container against rotation during the threading of the closure onto the container.

19. The drum of claim 18, including four indentations arranged at substantially 90° to one another and forming four of said ledges.

* * * * *